US010211037B2

(12) United States Patent
Wildgoose et al.

(10) Patent No.: US 10,211,037 B2
(45) Date of Patent: Feb. 19, 2019

(54) HISTOGRAMMING DIFFERENT ION AREAS ON PEAK DETECTING ANALOGUE TO DIGITAL CONVERTORS

(71) Applicant: Micromass UK Limited, Wilmslow (GB)

(72) Inventors: Jason Lee Wildgoose, Stockport (GB); Martin Raymond Green, Bowdon (GB); David J. Langridge, Macclesfield (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 15/314,571

(22) PCT Filed: Jun. 4, 2015

(86) PCT No.: PCT/GB2015/051627
§ 371 (c)(1),
(2) Date: Nov. 29, 2016

(87) PCT Pub. No.: WO2015/185930
PCT Pub. Date: Dec. 10, 2015

(65) Prior Publication Data

US 2017/0207073 A1 Jul. 20, 2017

(30) Foreign Application Priority Data

Jun. 4, 2014 (EP) ..... 14171210
Jun. 4, 2014 (GB) ..... 1409913.9

(51) Int. Cl.
*H01J 49/26* (2006.01)
*H01J 49/00* (2006.01)
*H01J 49/02* (2006.01)

(52) U.S. Cl.
CPC ..... *H01J 49/0036* (2013.01); *H01J 49/02* (2013.01)

(58) Field of Classification Search
None
See application file for complete search history.

(56) References Cited

U.S. PATENT DOCUMENTS 7,645,984 B2 1/2010 Gorenstein et al.
8,063,358 B2 * 11/2011 Bateman ..... H01J 49/0036 250/281

(Continued)

FOREIGN PATENT DOCUMENTS

WO WO 2011098834 A1 * 8/2011 ..... H01J 49/0036

*Primary Examiner* — Andrew Smyth
(74) *Attorney, Agent, or Firm* — Womble Bond Dickinson (US) LLP; Deborah M. Vernon; Heath T. Misley

(57) ABSTRACT

A method of mass spectrometry is disclosed comprising digitising a first signal output from an ion detector to produce a first digitised signal, detecting one or more peaks in the first digitised signal and determining a first area $S_0$ or a first intensity $I_0$ of the one or more peaks and a first arrival time $T_0$ of the one or more peaks thereby forming a first list of data pairs and determining whether or not the first area $S_0$ or the first intensity $I_0$ exceeds a first threshold area $S_{max}$ or a first threshold intensity $I_{max}$. The first threshold area $S_{max}$ and the first threshold intensity $I_{max}$ correspond respectively to a peak area and a peak intensity indicative of substantially simultaneous arrival of two ions which the ion detector is unable to resolve. If it is determined that the first area $S_0$ or the first intensity $I_0$ does not exceed the first threshold area $S_{max}$ or the first threshold intensity $I_0$ then the method further comprises including the first area $S_0$ or the first intensity $I_0$ and/or the first arrival time $T_0$ or data derived from the first area $S_0$ or the first intensity $I_0$ and/or the first arrival time $T_0$ in a first histogram.

17 Claims, 4 Drawing Sheets

(56) References Cited

U.S. PATENT DOCUMENTS

| | | | | |
|---|---|---|---|---|
| 8,612,162 | B2 | 12/2013 | Furuhashi et al. | |
| 8,735,808 | B2 | 5/2014 | Denny et al. | |
| 9,043,164 | B2 | 5/2015 | Makarov | |
| 9,053,911 | B2 | 6/2015 | Green et al. | |
| 9,514,922 | B2 | 12/2016 | Watanabe et al. | |
| 2002/0063208 | A1 | 5/2002 | Hastings | |
| 2004/0181351 | A1 | 9/2004 | Thompson et al. | |
| 2009/0321628 | A1* | 12/2009 | Bateman | H01J 49/0036 250/282 |
| 2012/0109537 | A1* | 5/2012 | Makarov | H01J 49/0036 702/27 |
| 2012/0126110 | A1* | 5/2012 | Green | G06K 9/0053 250/282 |
| 2014/0005954 | A1 | 1/2014 | Richardson et al. | |
| 2015/0235833 | A1* | 8/2015 | Bazargan | H01J 49/105 702/189 |

* cited by examiner

HISTOGRAMMING DIFFERENT ION AREAS ON PEAK DETECTING ANALOGUE TO DIGITAL CONVERTORS

CROSS-REFERENCE TO RELATED APPLICATION

This application represents the U.S. National Phase of International Application No. PCT/GB2015/051627entitled "Histogramming Different Ion Areas on Peak Detecting Analogue to Digital Convertiors" filed 4 Jun. 2015, which claims priority from and the benefit of United Kingdom Patent Application No. 1409913.9 filed on 4 Jun. 2014 and European Patent Application No. 14171210.9 filed on 4 Jun. 2014. The entire contents of these applications are incorporated herein by reference.

FIELD OF THE INVENTION

The present invention relates generally to mass spectrometry and in particular to a method of mass spectrometry, a control system for a mass spectrometer and a mass spectrometer.

BACKGROUND

Peak detecting analogue to digital convertors ("ADCs") are known and are described, for example, in U.S. Pat. No. 8,063,358 (Micromass). Peak detecting analogue to digital convertors have proven a useful device for enhancing the dynamic range, resolution and mass accuracy of orthogonal acceleration Time of Flight mass spectrometer instruments ("oa-ToF MS").

Whilst these enhancements have resulted in improved measurements the approach is not without some drawbacks.

One drawback of the known approach (and all ADC based systems) is the loss of accurate intensity and time measurements when the vertical range of the analogue to digital convertor is exceeded i.e. when the analogue to digital convertor is suffering from saturation effects. This is a particular problem for Time of Flight analysers with asymmetric arrival time distributions ("ATDs") and for ion detectors with asymmetric ion response profiles as the asymmetries result in time measurement shifts when the analogue signals exceed the vertical range of the analogue to digital convertor.

The approach described in U.S. Pat. No. 8,063,358 (Micromass) converts a detected ion peak into an intensity and arrival time value and results in improved performance relative to other height based approaches as the ion signals go into saturation and exceed the vertical range of the analogue to digital convertor. Whilst these improvements cause the system to fail in a more controlled manner it is still ultimately limited.

A second drawback which is specific to the approach described in U.S. Pat. No. 8,063,358 (Micromass) concerns the inability of the peak detection process to distinguish between multiple closely spaced (in time) ion response signals. In these situations, two or more closely spaced ion arrival events are interpreted as a single ion arrival event by the peak detection process and the two events are assigned a single arrival time and intensity value. This problem occurs more often when the ion response profiles are comparable with or greater than the analyser arrival time distribution ("ATD").

WO 2010/136765 (Micromass) discloses a method of processing mass spectral data wherein mass spectral data is filtered out as noise if the area of an ion peak is determined to be less than a threshold peak area.

US 2014/005954 (Micromass) discloses a method of processing LC-ToF MS data in which a 2D dataset is produced, and 2D features are detected in the dataset to produce a list of regions of interest. For each region of interest, a corrected time of flight measurement and a corrected intensity are inferred which may involve suppression or rejection of detected peaks arising from interfering species and/or overlapping regions of interest.

It is desired to provide an improved method of mass spectrometry.

SUMMARY

According to an aspect there is provided a method of mass spectrometry comprising:

digitising a first signal output from an ion detector to produce a first digitised signal;

detecting one or more peaks in the first digitised signal and determining a first area $S_0$ or a first intensity $I_0$ of the one or more peaks and a first arrival time $T_0$ of the one or more peaks thereby forming a first list of data pairs; and determining whether or not the first area $S_0$ or the first intensity $I_0$ exceeds a first threshold area $S_{max}$ or a first threshold intensity $I_{max}$, wherein the first threshold area $S_{max}$ and the first threshold intensity $I_{max}$ correspond respectively to a peak area and a peak intensity indicative of substantially simultaneous arrival of two ions which the ion detector is unable to resolve, and wherein if it is determined that the first area $S_0$ or the first intensity $I_0$ does not exceed the first threshold area $S_{max}$ or the first threshold intensity $I_0$ then the method further comprises including the first area $S_0$ or the first intensity $I_0$ and/or the first arrival time $T_0$ or data derived from the first area $S_0$ or the first intensity $I_0$ and/or the first arrival time $T_0$ in a first histogram.

An embodiment relates to histogramming different ion areas on peak detecting analogue to digital convertors and represents a new method of operating a mass spectrometer, particularly a Time of Flight mass spectrometer, wherein digitised ion signals are peak detected with only ions having responses in a particular range being histogrammed.

US 2014/005954 (Micromass) does not disclose how unwanted time of flight measurements and intensities are detected and suppressed or rejected.

The step of determining whether or not the first area $S_0$ or the first intensity $I_0$ exceeds the first threshold area $S_{max}$ or the first threshold intensity $I_{max}$ may be made on a push-by-push basis i.e. during a single acquisition of mass spectral data relating to applying e.g. a single orthogonal acceleration pulse to an orthogonal acceleration electrode of a Time of Flight mass analyser.

The step of determining whether or not the first area $S_0$ or the first intensity $I_0$ exceeds the first threshold area $S_{max}$ or the first threshold intensity $I_{max}$ may be made prior to combining or histogramming arrival time and area or intensity data pairs.

The step of determining whether or not the first area $S_0$ or the first intensity $I_0$ exceeds the first threshold area $S_{max}$ or the first threshold intensity $I_{max}$ may be made prior to combining or histogramming mass spectral data from separate acquisitions in order to build or form a composite mass spectrum.

If it is determined that the first area $S_0$ or the first intensity $I_0$ exceeds the first threshold area $S_{max}$ or the first threshold intensity $I_{max}$ then the method may further comprise filtering out, attenuating, rejecting or not including the first area $S_0$ or the first intensity $I_0$ and/or the first arrival time $T_0$ in the first histogram.

The method may further comprise filtering out, attenuating or otherwise rejecting one or more data pairs from the first list thereby forming a second reduced list, wherein a data pair is filtered out, attenuated or otherwise rejected from the first list if the first area $S_0$ or the first intensity $I_0$ of a peak in a data pair in the first list is determined to be less than a second threshold area $S_{min}$ or a second threshold intensity $I_{min}$.

The method may further comprise converting the first arrival time $T_0$ into a second arrival time $T_n$ and a third arrival time $T_{n+1}$.

The method may further comprise storing the second arrival time $T_n$ and/or the third arrival time $T_{n+1}$ in two or more substantially neighbouring or adjacent pre-determined time bins or memory locations.

According to an embodiment:

(i) the second arrival time $T_n$ is stored in a time bin or memory location immediately prior to or which includes the first arrival time $T_0$; and/or (ii) the third arrival time $T_{n+1}$ is stored in a pre-determined time bin or memory location immediately subsequent to or which includes the first arrival time $T_o$.

The method may further comprise converting the first peak area $S_0$ into a second peak area $S_0$ and a third peak area $S_{n+1}$.

The method may further comprise storing the second peak area $S_n$ and/or the third peak area $S_{n+1}$ in two or more substantially neighbouring or adjacent pre-determined time bins or memory locations.

According to an embodiment:

(i) the second peak area $S_n$ is stored in a pre-determined time bin or memory location immediately prior to or which includes the first arrival time $T_0$; and/or (ii) the third peak area $S_{n+1}$ is stored in a pre-determined time bin or memory location immediately subsequent to or which includes the first arrival time $T_0$.

In an embodiment:

(i) the first peak area $S_0$ follows the relationship $S_0=S_n+S_{n+1}$; and/or (ii) $S_o \cdot T_o$ follows the relationship $S_n \cdot T_n+S_{n+1} \cdot T_{n+1}=S_0 \cdot T_0$ The method may further comprise replacing the first arrival time $T_0$ and the first peak area $S_0$ of at least some of the peaks with the second arrival time $T_n$ and the second peak area $S_n$ and the third arrival time $T_{n+1}$ and the third peak area $S_{n+1}$.

The method may further comprise converting the first intensity $I_0$ into a second intensity $I_n$ and a third intensity $I_{n+1}$.

The method may further comprise storing the second intensity $I_n$ and/or the third intensity $I_{n+1}$ in two or more substantially neighbouring or adjacent pre-determined time bins or memory locations.

Each predetermined time bin or memory location may have a width, wherein the width falls within a range selected from the group consisting of: (i) <1 ps; (ii) 1-10 ps; (iii) 10-100 ps; (iv) 100-200 ps; (v) 200-300 ps; (vi) 300-400 ps; (vii) 400-500 ps; (viii) 500-600 ps; (ix) 600-700 ps; (x) 700-800 ps; (xi) 800-900 ps; (xii) 900-1000 ps; (xiii) 1-2 ns; (xiv) 2-3 ns; (xv) 3-4 ns; (xvi) 4-5 ns; (xvii) 5-6 ns; (xviii) 6-7 ns; (xix) 7-8 ns; (xx) 8-9 ns; (xxi) 9-10 ns; (xxii) 10-100 ns; (xxiii) 100-500 ns; (xxiv) 500-1000 ns; (xxv) 1-10 μs; (xxvi) 10-100 μs; (xxvii) 100-500 μs; (xxviii) >500 μs.

According to an embodiment:

(i) the first signal comprises an output signal, a voltage signal, an ion signal, an ion current, a voltage pulse or an electron current pulse; and/or (ii) the ion detector comprises a microchannel plate, a photomultiplier or an electron multiplier device; and/or (iii) the ion detector comprises a current to voltage converter or amplifier for producing a voltage pulse in response to the arrival of one or more ions at the ion detector.

The method may further comprise applying an amplitude threshold to the first digitised signal prior to determining the first area $S_0$ or the first intensity $I_0$ of the one or more peaks and the first arrival time $T_0$ of the one or more peaks in order to filter out at least some noise spikes from the first digitised signal.

The method may further comprise smoothing the first digitised signal using a moving average, boxcar integrator, Savitsky Golay or Hites Biemann algorithm prior to determining the first area $S_0$ or the first intensity $I_0$ of the one or more peaks and the first arrival time $T_0$ of the one or more peaks.

The method may further comprise determining or obtaining a second differential or a second difference of the first digitised signal prior to determining the first area $S_0$ or the first intensity $I_0$ of the one or more peaks and the first arrival time $T_0$ of the one or more peaks.

The step of determining the first arrival time $T_o$ of the one or more peaks may comprise determining one or more zero crossing points of the second differential of the first digitised signal.

The method may further comprise:

determining or setting a start time $T_{0start}$ of an ion arrival event as corresponding to a digitisation interval which is immediately prior or subsequent to the time when the second differential of the first digitised signal falls below zero or another value; and determining or setting an end time $T_{0end}$ of an ion arrival event as corresponding to a digitisation interval which is immediately prior or subsequent to the time when the second differential of the first digitised signal rises above zero or another value.

The method may further comprise:

(i) determining the peak area of one or more peaks present in the first digitised signal which correspond to one or more ion arrival events, wherein the step of determining the peak area of one or more peaks present in the first digitised signal comprises determining the area of one or more peaks present in the first digitised signal bounded by the start time $T_{0start}$ and/or by the end time $T_{0end}$; and/or (ii) determining the moment of one or more peaks present in the first digitised signal which correspond to one or more ion arrival events, wherein the step of determining the moment of one or more peaks present in the first digitised signal which correspond to one or more ion arrival events comprises determining the moment of a peak bounded by the start time $T_{0start}$ and/or by the end time $T_{0end}$; and/or (iii) determining the centroid time of one or more peaks present in the first digitised signal which correspond to one or more ion arrival events; and/or (iv) determining the average or representative time of one or more peaks present in the first digitised signal which correspond to one or more ion arrival events.

The method may further comprise obtaining the first signal over an acquisition time period, wherein the length of the acquisition time period is selected from the group consisting of: (i) <1 μs; (ii) 1-10 μs; (iii) 10-20 μs; (iv) 20-30 μs; (v) 30-40 μs; (vi) 40-50 μs; (vii) 50-60 μs; (viii) 60-70 μs; (ix) 70-80 μs; (x) 80-90 μs; (xi) 90-100 μs; (xii) 100-110 μs;

(xiii) 110-120 μs; (xiv) 120-130 μs; (xv) 130-140 μs; (xvi) 140-150 μs; (xvii) 150-160 μs; (xviii) 160-170 μs; (xix) 170-180 μs; (xx) 180-190 μs; (xxi) 190-200 μs; (xxii) 200-250 μs; (xxiii) 250-300 μs; (xxiv) 300-350 μs; (xxv) 350-400 μs; (xxvi) 450-500 μs; (xxvii) 500-1000 μs; and (xxviii) >1 ms;

wherein the method may further comprise sub-dividing the acquisition time period into n time bins or memory locations, wherein n is selected from the group consisting of: (i) <100; (ii) 100-1000; (iii) 1000-10000; (iv) 10,000-100,000; (v) 100,000-200,000; (vi) 200,000-300,000; (vii) 300,000-400,000; (viii) 400,000-500,000; (ix) 500,000-600,000; (x) 600,000-700,000; (xi) 700,000-800,000; (xii) 800,000-900,000; (xiii) 900,000-1,000,000; and (xiv) >1,000,000;

wherein each the time bin or memory location may have substantially the same length, width or duration.

The method may further comprise using an Analogue to Digital Converter or a transient recorder to digitise the first and optional further signal(s).

According to an embodiment:

(a) the Analogue to Digital Converter or transient recorder comprises a n-bit Analogue to Digital Converter or transient recorder, wherein n comprises 5, 6, 7, 8, 9, 10, 11, 12, 13, 14, 15, 16, 17, 18, 19, 20 or >20; and/or (b) the Analogue to Digital Converter or transient recorder has a sampling or acquisition rate selected from the group consisting of: (i)<1 GHz; (ii) 1-2 GHz; (iii) 2-3 GHz; (iv) 3-4 GHz; (v) 4-5 GHz; (vi) 5-6 GHz; (vii) 6-7 GHz; (viii) 7-8 GHz; (ix) 8-9 GHz; (x) 9-10 GHz; and (xi) >10 GHz; and/or (c) the Analogue to Digital Converter or transient recorder has a digitisation rate which is substantially uniform or non-uniform.

The method may further comprise subtracting a constant number or value from the first digitised signal, wherein if a portion of the first digitised signal falls below zero after subtraction of a constant number or value from the first digitised signal then the method further comprises resetting the portion of the first digitised signal to zero.

The method may further comprise:

digitising one or more further signals output from the ion detector to produce one or more further digitised signals;

detecting one or more peaks in the one or more further digitised signals and determining a first area $S_0$ or a first intensity $I_0$ of the one or more peaks and a first arrival time $T_0$ of the one or more peaks thereby forming a first list of data pairs; and determining whether or not the first area $S_0$ or the first intensity $I_0$ exceeds a first threshold area $S_{max}$ or a first threshold intensity $I_{max}$ wherein if it is determined that the first area $S_0$ or the first intensity $I_0$ does not exceed the first threshold area $S_{max}$ or the first threshold intensity $I_0$ then the method further comprises including the first area $S_0$ or the first intensity $I_0$ and/or the first arrival time $T_0$ or data derived from the first area $S_0$ or the first intensity $I_0$ and/or the first arrival time $T_0$ in the first histogram.

The one or more further signals may comprise at least 5, 10, 15, 20, 25, 30, 35, 40, 45, 50, 55, 60, 65, 70, 75, 80, 85, 90, 95, 100, 200, 300, 400, 500, 600, 700, 800, 900, 1000, 2000, 3000, 4000, 5000, 6000, 7000, 8000, 9000 or 10000 signals from the ion detector, each signal corresponding to a separate experimental run or acquisition.

The method may further comprise combining or histogramming the second peak area $S_n$ and the third peak area $S_{n+1}$ corresponding to the first digitised signal with the second peak area(s) $S_n$ and the third peak area(s) $S_{n+1}$ corresponding to the one or more further digitised signals to form a composite time or mass spectrum.

The method may further comprise:

determining whether or not the first area $S_0$ or the first intensity $I_0$ exceeds a third threshold area $S'_{max}$ or a third threshold intensity $I'_{max}$, wherein if it is determined that the first area $S_0$ or the first intensity $I_0$ does not exceed the third threshold area $S'_{max}$ or the third threshold intensity $I_0$ then the method further comprises including the first area $S_0$ or the first intensity $I_0$ and/or the first arrival time $T_0$ or data derived from the first area $S_0$ or the first intensity $I_0$ and/or the first arrival time $T_0$ in the first histogram.

The method may further comprise filtering out, attenuating or otherwise rejecting one or more data pairs, wherein a data pair is filtered out, attenuated or otherwise rejected if the first area $S_0$ or the first intensity $I_0$ is determined to be less than a fourth threshold area $S'_{min}$ or a fourth threshold intensity $I'_{min}$.

According to the embodiments the first area $S_0$ or the first intensity $I_0$ and/or the first arrival time $T_0$ may be included in the first histogram if the first area $S_0$ or the first intensity $I_0$ is between a first (upper) area threshold $S_{max}$ or a first (upper) intensity threshold $I_{max}$ and a second (lower) area threshold $S_{min}$ or a second (lower) intensity threshold $I_{min}$ and optionally wherein the first area $S_0$ or the first intensity $I_0$ is also between a third (upper) area threshold $S'_{max}$ or a third (upper) intensity threshold $I'_{max}$ and a fourth (lower) area threshold $S'_{min}$ or a fourth (lower) intensity threshold $I_{min}$. Accordingly, embodiments are contemplated wherein the first area $S_0$ or the first intensity $I_0$ and/or the first arrival time $T_0$ may be included in the first histogram if the first area $S_0$ or the first intensity $I_0$ fall within one or two different ranges. Further embodiments are contemplated wherein the first area $S_0$ or the first intensity $I_0$ and/or the first arrival time $T_0$ may be included in the first histogram if the first area $S_0$ or the first intensity $I_0$ fall within one of three, four, five, six, seven, eight, nine, ten or more than ten different ranges.

The method may further comprise determining one or more further characteristics or metrics related to the one or more peaks.

The one or more further characteristics or metrics related to the one or more peaks may comprise: (i) the standard deviation of the one or more peaks, the full width at half maximum ("FWHM") of the one or more peaks or another value relating to the width or peak shape of the one or more peaks; and/or (ii) the kurtosis of the one or more peaks; and/or (iii) the skew of the one or more peaks, the absolute value of the skew of the one or more peaks or the modulus of the skew of the one or more peaks.

The method may further comprise determining whether or not the one or more further characteristics or metrics exceeds a first maximum threshold $X_{max}$, wherein:

(i) if it is determined that the one or more further characteristics or metrics does not exceed the first maximum threshold $X_{max}$ then the method further comprises including the first area $S_0$ or the first intensity $I_0$ and/or the first arrival time $T_0$ or data derived from the first area $S_0$ or the first intensity $I_0$ and/or the first arrival time $T_0$ in the first histogram;

and/or (ii) if it is determined that the one or more further characteristics or metrics exceeds the first maximum threshold $X_{max}$ then the method further comprises filtering out, attenuating, rejecting or not including the first area $S_0$ or the first intensity $I_0$ and/or the first arrival time $T_0$ in the first histogram.

The method may further comprise determining whether or not the one or more further characteristics or metrics exceeds a first minimum threshold $X_{min}$, wherein:

(i) if it is determined that the one or more further characteristics or metrics exceeds the first minimum threshold $X_{min}$ then the method further comprises including, the first area $S_0$ or the first intensity $I_0$ and/or the first arrival time $T_0$ or data derived from the first area $S_0$ or the first intensity $I_0$ and/or the first arrival time $T_0$ in the first histogram; and/or (ii) if it is determined that the one or more further characteristics or metrics does not exceed the first minimum threshold $X_{min}$ then the method further comprises filtering out, attenuating, rejecting or not including the first area $S_0$ or the first intensity $I_0$ and/or the first arrival time $T_0$ in the first histogram.

According to another aspect there is provided a control system for a mass spectrometer, wherein the control system is arranged and adapted:

(i) to digitise a first signal output from an ion detector to produce a first digitised signal;

(ii) to detect one or more peaks in the first digitised signal and to determine a first area $S_0$ or a first intensity $I_0$ of the one or more peaks and a first arrival time $T_0$ of the one or more peaks thereby forming a first list of data pairs; and (iii) to determine whether or not the first area $S_0$ or the first intensity $I_0$ exceeds a first threshold area $S_{max}$ or a first threshold intensity $I_{max}$, wherein the first threshold area $S_{max}$ and the first threshold intensity $I_{max}$ correspond respectively to a peak area and a peak intensity indicative of substantially simultaneous arrival of two ions which the ion detector is unable to resolve, and wherein if it is determined that the first area $S_0$ or the first intensity $I_0$ does not exceed the first threshold area $S_{max}$ or the first threshold intensity $I_0$ then the control system is further arranged and adapted to include the first area $S_0$ or the first intensity $I_0$ and/or the first arrival time $T_0$ or data derived from the first area $S_0$ or the first intensity $I_0$ and/or the first arrival time $T_0$ in a first histogram.

According to another aspect there is provided a mass spectrometer comprising a control system as described above.

The mass spectrometer may further comprise an Analogue to Digital Converter or a transient recorder to digitise the first signal.

According to an embodiment:

(a) the Analogue to Digital Converter or transient recorder comprises a n-bit Analogue to Digital Converter or transient recorder, wherein n comprises 5, 6, 7, 8, 9, 10, 11, 12, 13, 14, 15, 16, 17, 18, 19, 20 or >20; and/or (b) the Analogue to Digital Converter or transient recorder has a sampling or acquisition rate selected from the group consisting of: (i)<1 GHz; (ii) 1-2 GHz; (iii) 2-3 GHz; (iv) 3-4 GHz; (v) 4-5 GHz; (vi) 5-6 GHz; (vii) 6-7 GHz; (viii) 7-8 GHz; (ix) 8-9 GHz; (x) 9-10 GHz; and (xi) >10 GHz; and/or (c) the Analogue to Digital Converter or transient recorder has a digitisation rate which is substantially uniform or non-uniform.

According to another aspect there is provided a method of mass spectrometry comprising:

digitising a first signal output from an ion detector to produce a first digitised signal;

detecting one or more peaks in the first digitised signal and determining a first area $S_0$ or a first intensity $I_0$ of the one or more peaks and a first mass or mass to charge ratio $M_0$ of the one or more peaks thereby forming a first list of data pairs; and determining whether or not the first area $S_0$ or the first intensity $I_0$ exceeds a first threshold area $S_{max}$ or a first threshold intensity $I_{max}$, wherein the first threshold area $S_{max}$ and the first threshold intensity $I_{max}$ correspond respectively to a peak area and a peak intensity indicative of substantially simultaneous arrival of two ions which the ion detector is unable to resolve, and wherein if it is determined that the first area $S_0$ or the first intensity $I_0$ does not exceed the first threshold area $S_{max}$ or the first threshold intensity $I_0$ then the method further comprises including the first area $S_0$ or the first intensity $I_0$ and/or the first mass or mass to charge ratio $M_0$ or data derived from the first area $S_0$ or the first intensity $I_0$ and/or the first mass or mass to charge ratio $M_0$ in a first histogram.

According to another aspect there is provided a control system for a mass spectrometer, wherein the control system is arranged and adapted:

(i) to digitise a first signal output from an ion detector to produce a first digitised signal;

(ii) to detect one or more peaks in the first digitised signal and to determine a first area $S_0$ or a first intensity $I_0$ of the one or more peaks and a first mass or mass to charge ratio $M_0$ of the one or more peaks thereby forming a first list of data pairs; and (iii) to determine whether or not the first area $S_0$ or the first intensity $I_0$ exceeds a first threshold area $S_{max}$ or a first threshold intensity $I_{max}$, wherein the first threshold area $S_{max}$ and the first threshold intensity $I_{max}$ correspond respectively to a peak area and a peak intensity indicative of substantially simultaneous arrival of two ions which the ion detector is unable to resolve, and wherein if it is determined that the first area $S_0$ or the first intensity $I_0$ does not exceed the first threshold area $S_{max}$ or the first threshold intensity $I_0$ then the control system is further arranged and adapted to include the first area $S_0$ or the first intensity $I_0$ and/or the first mass or mass to charge ratio $M_0$ or data derived from the first area $S_0$ or the first intensity $I_0$ and/or the first mass or mass to charge ratio $M_0$ in a first histogram.

According to an aspect there is provided a method of mass spectrometry comprising:

digitising a first signal output from an ion detector to produce a first digitised signal;

detecting one or more peaks in the first digitised signal and determining one or more characteristics or metrics related to the one or more peaks selected from the group consisting of: (i) the standard deviation of the one or more peaks, the full width at half maximum ("FWHM") of the one or more peaks or another value relating to the width or peak shape of the one or more peaks; and/or (ii) the kurtosis of the one or more peaks; and/or (iii) the skew of the one or more peaks, the absolute value of the skew of the one or more peaks or the modulus of the skew of the one or more peaks; and determining whether or not the one or more characteristics or metrics exceeds a first maximum threshold $X_{max}$, wherein the first maximum threshold $X_{max}$ corresponds to substantially simultaneous arrival of two ions which the ion detector is unable to resolve, and wherein if it is determined that the one or more characteristics or metrics does not exceed the first maximum threshold $X_{max}$ then the method further comprises:

(i) determining a first area $S_0$ or a first intensity $I_0$ of the one or more peaks and a first arrival time T0 of the one or more peaks thereby forming a first list of data pairs; and (ii) including the first area $S_0$ or the first intensity $I_0$ and/or the first arrival time $T_0$ or data derived from the first area $S_0$ or the first intensity $I_0$ and/or the first arrival time $T_0$ in a first histogram.

According to an aspect there is provided a method of mass spectrometry comprising:

digitising a first signal output from an ion detector to produce a first digitised signal;

detecting one or more peaks in the first digitised signal and determining one or more characteristics or metrics related to the one or more peaks selected from the group consisting of: (i) the standard deviation of the one or more peaks, the full width at half maximum ("FWHM") of the one or more peaks or another value relating to the width or peak shape of the one or more peaks; and/or (ii) the kurtosis of the one or more peaks; and/or (iii) the skew of the one or more peaks, the absolute value of the skew of the one or more peaks or the modulus of the skew of the one or more peaks;

determining a first area $S_0$ or a first intensity $I_0$ of the one or more peaks and a first arrival time T0 of the one or more peaks thereby forming a first list of data pairs; and determining whether or not the one or more characteristics or metrics exceeds a first maximum threshold $X_{max}$, wherein the first maximum threshold $X_{max}$ corresponds to substantially simultaneous arrival of two ions which the ion detector is unable to resolve, and wherein if it is determined that the one or more characteristics or metrics does not exceed the first maximum threshold $X_{max}$ then the method further comprises including the first area $S_0$ or the first intensity $I_0$ and/or the first arrival time $T_0$ or data derived from the first area $S_0$ or the first intensity $I_0$ and/or the first arrival time $T_0$ in a first histogram.

According to an embodiment if it is determined that the one or more further characteristics or metrics exceeds the first maximum threshold $X_{max}$ then the method further comprises filtering out, attenuating, rejecting or not including the first area $S_0$ or the first intensity $I_0$ and/or the first arrival time $T_0$ in the first histogram.

The method may further comprise determining whether or not the one or more further characteristics or metrics exceeds a first minimum threshold $X_{min}$, wherein:

(i) if it is determined that the one or more further characteristics or metrics exceeds the first minimum threshold $X_{min}$ then the method further comprises including the first area $S_0$ or the first intensity $I_0$ and/or the first arrival time $T_0$ or data derived from the first area $S_0$ or the first intensity $I_0$ and/or the first arrival time $T_0$ in the first histogram; and/or (ii) if it is determined that the one or more further characteristics or metrics does not exceed the first minimum threshold $X_{min}$ then the method further comprises filtering out, attenuating, rejecting or not including the first area $S_0$ or the first intensity $I_0$ and/or the first arrival time $T_0$ in the first histogram.

According to an aspect there is provided a control system for a mass spectrometer, wherein the control system is arranged and adapted:

(i) to digitise a first signal output from an ion detector to produce a first digitised signal;

(ii) to detect one or more peaks in the first digitised signal and determine one or more characteristics or metrics related to the one or more peaks selected from the group consisting of: (a) the standard deviation of the one or more peaks, the full width at half maximum ("FWHM") of the one or more peaks or another value relating to the width or peak shape of the one or more peaks; and/or (b) the kurtosis of the one or more peaks; and/or (c) the skew of the one or more peaks, the absolute value of the skew of the one or more peaks or the modulus of the skew of the one or more peaks; and (iii) to determine whether or not the one or more characteristics or metrics exceeds a first maximum threshold $X_{max}$, wherein the first maximum threshold $X_{max}$ corresponds to substantially simultaneous arrival of two ions which the ion detector is unable to resolve, and wherein if it is determined that the one or more characteristics or metrics does not exceed the first maximum threshold $X_{max}$ then the control system is further arranged and adapted:

(iv) to determine a first area $S_0$ or a first intensity $I_0$ of the one or more peaks and a first arrival time T0 of the one or more peaks thereby forming a first list of data pairs; and (v) to include the first area $S_0$ or the first intensity $I_0$ and/or the first arrival time $T_0$ or data derived from the first area $S_0$ or the first intensity $I_0$ and/or the first arrival time $T_0$ in a first histogram.

According to an aspect there is provided a control system for a mass spectrometer, wherein the control system is arranged and adapted:

(i) to digitise a first signal output from an ion detector to produce a first digitised signal;

(ii) to detect one or more peaks in the first digitised signal and determine one or more characteristics or metrics related to the one or more peaks selected from the group consisting of: (a) the standard deviation of the one or more peaks, the full width at half maximum ("FWHM") of the one or more peaks or another value relating to the width or peak shape of the one or more peaks; and/or (b) the kurtosis of the one or more peaks; and/or (c) the skew of the one or more peaks, the absolute value of the skew of the one or more peaks or the modulus of the skew of the one or more peaks;

(iii) to determine a first area $S_0$ or a first intensity $I_0$ of the one or more peaks and a first arrival time T0 of the one or more peaks thereby forming a first list of data pairs; and (iv) to determine whether or not the one or more characteristics or metrics exceeds a first maximum threshold $X_{max}$, wherein the first maximum threshold $X_{max}$ corresponds to substantially simultaneous arrival of two ions which the ion detector is unable to resolve, and wherein if it is determined that the one or more characteristics or metrics does not exceed the first maximum threshold $X_{max}$ then the control system is further arranged and adapted to include the first area $S_0$ or the first intensity $I_0$ and/or the first arrival time $T_0$ or data derived from the first area $S_0$ or the first intensity $I_0$ and/or the first arrival time $T_0$ in a first histogram.

According to an aspect there is provided an apparatus for mass spectrometry comprising:

a Time of Flight mass spectrometer with a peak detecting ADC where events in a restricted response range are histogrammed and wherein the restricted response range includes a maximum value.

The response may be related to the detected area of an event.

More than one response range may be histogrammed and kept separate or combined.

Measurements in one histogram may be assigned to measurements in one or more other histograms.

According to an aspect there is provided a method of mass spectrometry comprising:

digitising a first signal output from an ion detector to produce a first digitised signal;

detecting one or more peaks in the first digitised signal and determining a first area $S_0$ or a first intensity $I_0$ of the one or more peaks and a first arrival time $T_0$ of the one or more peaks thereby forming a first list of data pairs; and determining whether or not the first area $S_0$ or the first intensity $I_0$ exceeds a first threshold area $S_{max}$ or a first threshold intensity $I_{max}$, wherein if it is determined that the first area $S_0$ or the first intensity $I_0$ does not exceed the first threshold area $S_{max}$ or the first threshold intensity $I_0$ then the method further comprises including the first area $S_0$ or the first intensity $I_0$ and/or the first arrival time $T_0$ or data derived from the first area $S_0$ or the first intensity $I_0$ and/or the first arrival time $T_0$ in a first histogram.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage optionally has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi) >about 500 V peak to peak.

The AC or RF voltage may have a frequency selected from the group consisting of: (i) <about 100 kHz; (ii) about 100-200 kHz; (iii) about 200-300 kHz; (iv) about 300-400 kHz; (v) about 400-500 kHz; (vi) about 0.5-1.0 MHz; (vii) about 1.0-1.5 MHz; (viii) about 1.5-2.0 MHz; (ix) about 2.0-2.5 MHz; (x) about 2.5-3.0 MHz; (xi) about 3.0-3.5 MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) >about 10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide may be maintained at a pressure selected from the group consisting of: (i) <about 0.0001 mbar; (ii) about 0.0001-0.001 mbar; (iii) about 0.001-0.01 mbar; (iv) about 0.01-0.1 mbar; (v) about 0.1-1 mbar; (vi) about 1-10 mbar; (vii) about 10-100 mbar; (viii) about 100-1000 mbar; and (ix) >about 1000 mbar.

According to an embodiment analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

According to an embodiment in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions may comprise peptides, polypeptides, proteins or biomolecules.

According to an embodiment in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenylanthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

According to an embodiment the process of Electron Transfer Dissociation fragmentation comprises interacting analyte ions with reagent ions, wherein the reagent ions comprise dicyanobenzene, 4-nitrotoluene or azulene.

BRIEF DESCRIPTION OF THE DRAWINGS

Various embodiments will now be described, by way of example only, and with reference to the accompanying drawings in which.

DETAILED DESCRIPTION

An example of an ion detector system will first be described in more detail.

Figure 1:
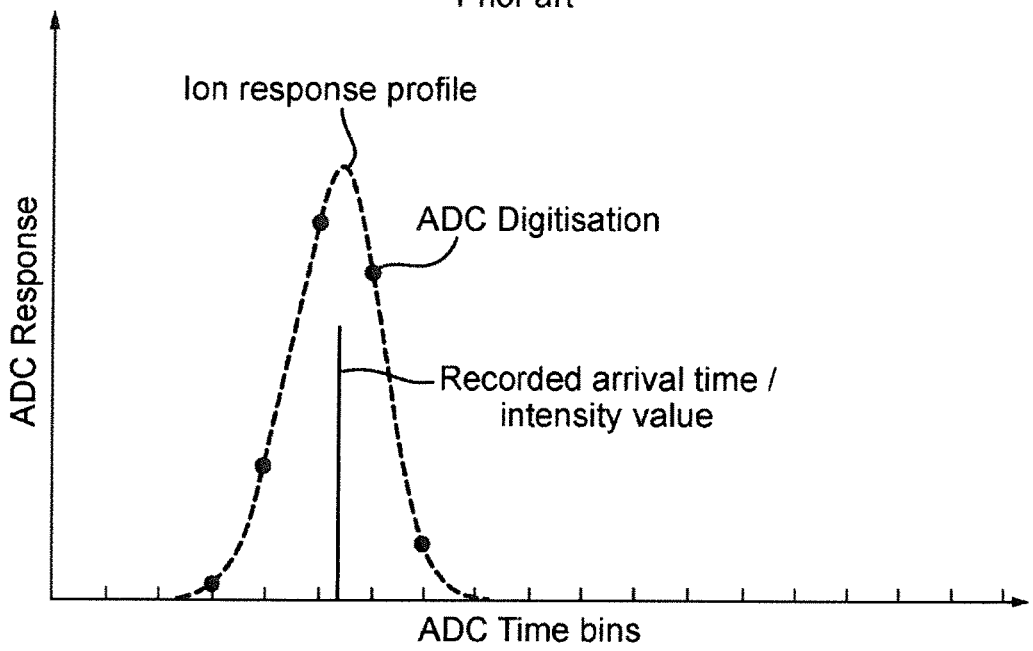
Fig. 1 Prior art
FIG. 1 illustrates a conventional peak detection and time/intensity assignment applied to a single ion arrival event wherein a digitised ion peak is converted to an arrival time and intensity value.

FIG. 1 shows a simplified schematic illustrating the known peak detection and time/intensity assignment principle as described in U.S. Pat. No. 8,063,358 (Micromass).

According to the conventional approach digitised ADC values are interrogated on a push by push basis to determine the presence of an ion peak before calculating the arrival time and intensity of the ion peak. The arrival time can be calculated and assigned to sub bin accuracy or precision thereby improving the performance compared with other conventional peak top or edge detection systems. In the particular example shown in FIG. 1 the intensity assignment is arbitrary and is not intended to reflect the true ion area.

Figure 2:
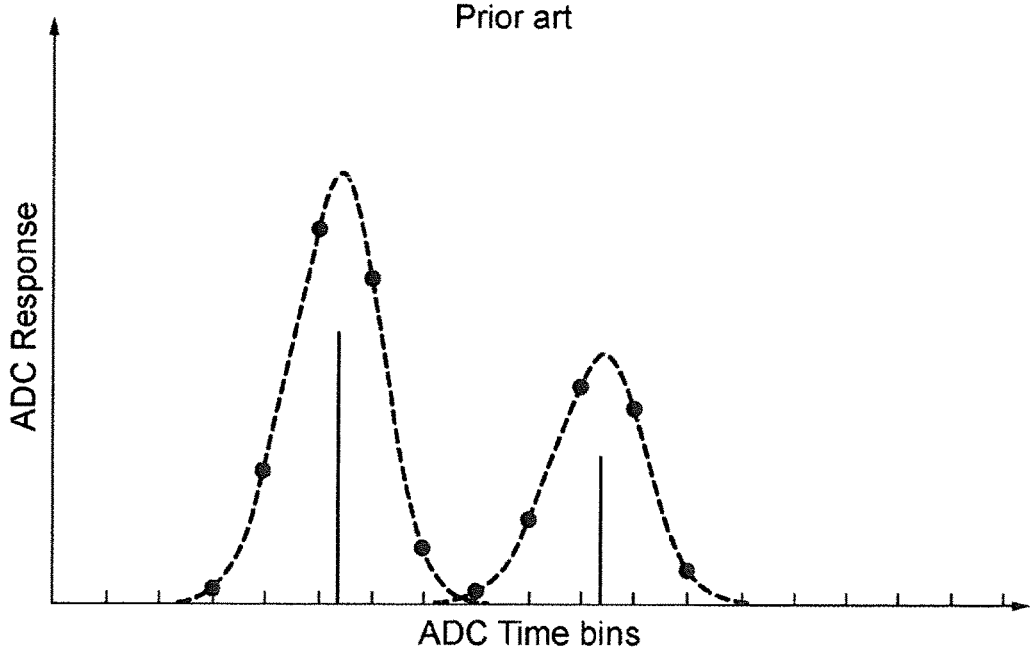
Fig. 2 Prior art
FIG. 2 illustrates a conventional peak detection and time/intensity assignment applied to two ion arrival events within a single push wherein the ion arrival events are separated in time by a sufficient amount so as to allow the individual ion arrival events to be peak detected so that the two ion peaks are converted into two arrival times and intensity values.

FIG. 2 illustrates the same conventional approach applied to two separate ion arrival events which occur within a single push. The ion arrival events are separated in time by a sufficient amount so as to allow the individual events to be peak detected.

The different intensities of the two peaks shown in FIG. 2 is intended to illustrate the effects of the pulse height distribution ("PHD") which is associated with many ion detectors rather than relating to different numbers of ions arriving at the ion detector. It will be understood that ion detectors can output ion peaks which have a height which varies from detected ion to detected ion.

In FIGS. 1 and 2 the peak detection and time/intensity assignment effectively removes the contribution of the temporal widths of the ion response signal from the final observed mass spectral peak widths thereby effectively improving the resolution compared with other conventional averaging analogue to digital convertor systems when many pushes are combined.

Figure 3:
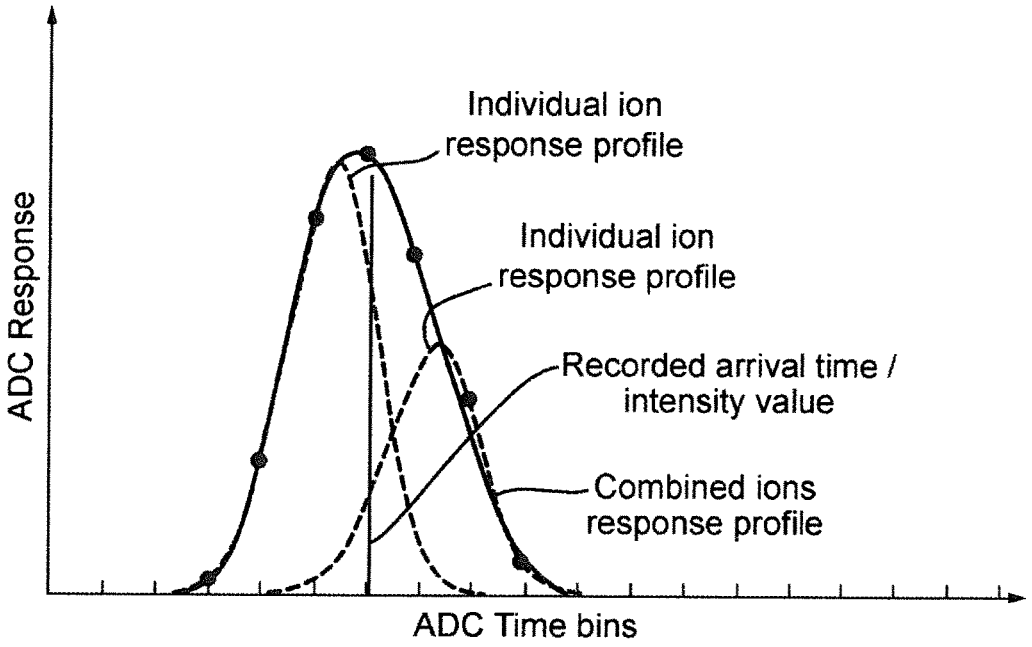
Fig. 3 Prior art
FIG. 3 illustrates a conventional peak detection and time/intensity assignment applied to two ion arrival events within a single push wherein the ion arrival events are close to each other so that the system records a single arrival time and intensity value.

FIG. 3 shows a schematic of the same two ion response signals as shown in FIG. 2 but wherein the two ion response signals are now much closer together in time. As the two signals arrive in a single push, the profile displayed represents a combination or summing of the two individual responses to form a combined ion response profile. As the two events arrive separated in time by a value comparable with the width of the ion response profile, the combined profile appears, and is interpreted by the peak detection software, as a single ion arrival event. Accordingly, the two separate ion arrival events are assigned a single time and intensity value.

When multiple pushes are combined, this effect leads to coalescence of closely spaced mass or time peaks with a disadvantageous consequent loss of mass/time resolution and accuracy. This effect will be explained in more detail below with reference to FIGS. 4A and 4B.

Figure 4A:
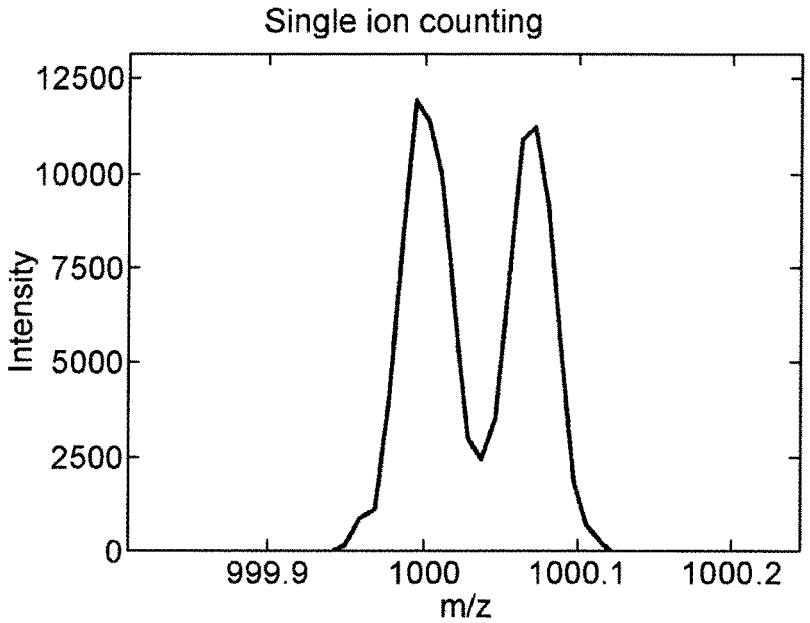
Fig. 4A Prior art
FIG. 4A shows the result of a single ion counting simulation and FIG. 4B shows the result of a simulation wherein ions arrive with a mean arrival rate of two ions per push and are detected by a conventional detector system.
Figure 4B:
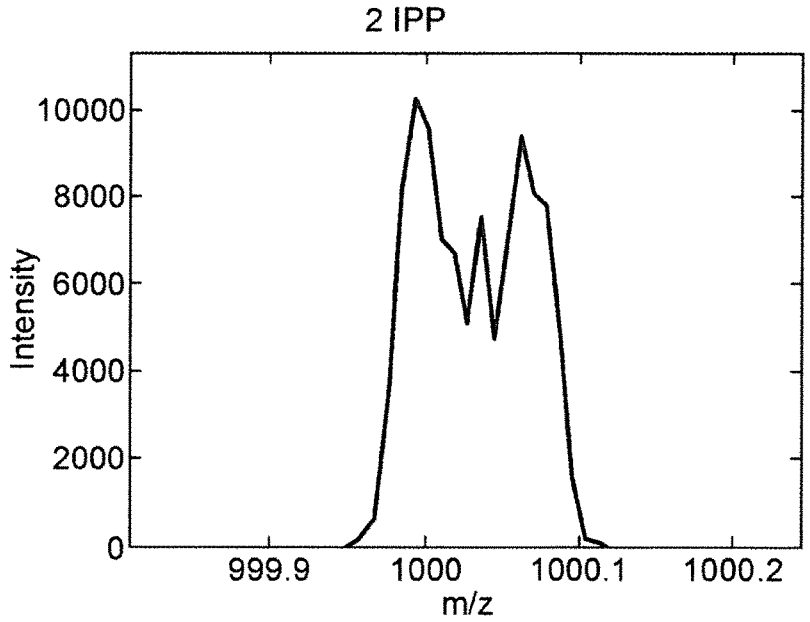
Fig. 4B Prior art

FIGS. 4A and 4B show the results of two simulations. FIG. 4A shows data simulated in a single ion counting experiment wherein only one ion arrival event is allowed to arrive at the ion detector per push. Ignoring digitisation effects, and combining thousands of pushes, FIG. 4A represents the true arrival time distribution ("ATD") of the analyser for two species/components closely spaced in mass to charge ratio.

In the second simulation, the results of which are shown in FIG. 4B, the same two components having similar mass to charge ratios are allowed to arrive at the ion detector according to a Poisson probability distribution with a mean arrival rate of two ions per push ("2 IPP"). According to this simulation, some pushes have only one event per push whereas other pushes have two, three or more events per push due to the Poisson distribution which governs ion arrival rates.

The measurement of single event pushes is accurate whereas the measurement of multiple event pushes suffers from the aforementioned drawbacks as the single ion response widths are comparable to the separation of the two components in the simulation.

When thousands of pushers are combined or histogrammed the arrival time distributions ("ATDs") appear to coalesce and reduce the resolution which is apparent from comparing the mass spectrum shown in FIG. 4B with the (ideal) mass spectrum as shown in FIG. 4A.

An attempt can be made to partially alleviate this problem by de-convoluting overlapping ion responses on a push by push basis in a manner as described in WO 2011/098834 (Micromass) or on data from combined pushes. However, such an approach can be time consuming and can result in spectral artefacts.

An embodiment will now be described.

The embodiment relates to an improved method of histogramming ADC data whereby only events within a chosen ion area range are histogrammed i.e. wherein only ion peaks having an ion area or intensity greater than (or equal to) a minimum threshold and less than (or equal to) a maximum threshold are included or histogrammed. In particular, if a detected ion peak has an ion area which exceeds an (upper) threshold then this may be indicative of the fact that the ion peak actually corresponds to the near simultaneous arrival of two ions which the ion detector is unable to resolve.

The embodiment provides an improvement over the conventional approach by utilising the strong correlation between the measured area of an ion peak and the number of ion arrival events per push. This correlation allows the setting of thresholds corresponding to a restricted range of ion areas and thus a restricted range of ions per push. According to the embodiment only ion peaks having an ion peak area below a certain threshold are considered to relate to a single ion arrival event and hence the corresponding intensity and arrival time values are further processed or histogrammed. Ion peaks having an ion peak area above the (upper) threshold are considered to relate to multiple ion arrival events and the corresponding intensity and arrival time values are not further processed or histogrammed.

The correlation is not perfect as the pulse height distribution ("PHD") of the ion detector and the digitisation quantisation effects may mean that single ions will have a range of measured ion areas. The approach according to the embodiment will therefore benefit from new generations of ion detectors which are being developed which have an improved pulsed height distribution and digitisation. Nonetheless, the application of an ion peak area threshold according to the embodiment results in a significant improvement in the shape of the resultant arrival time distribution for ions and thus represents a significant advance in the art.

Figure 5A:
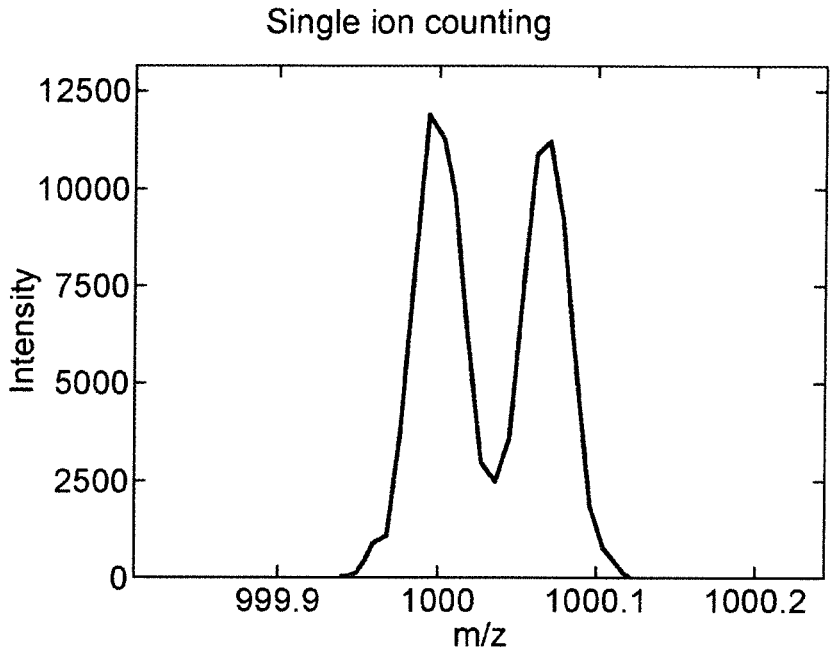
FIG. 5A illustrates the result of a single ion counting simulation and FIG. 5B shows the result of a simulation according to an embodiment wherein ions arrive with a mean arrival rate of two ions per push and are detected by a detector system according to an embodiment wherein an upper ion peak area threshold is applied.
Figure 5B:
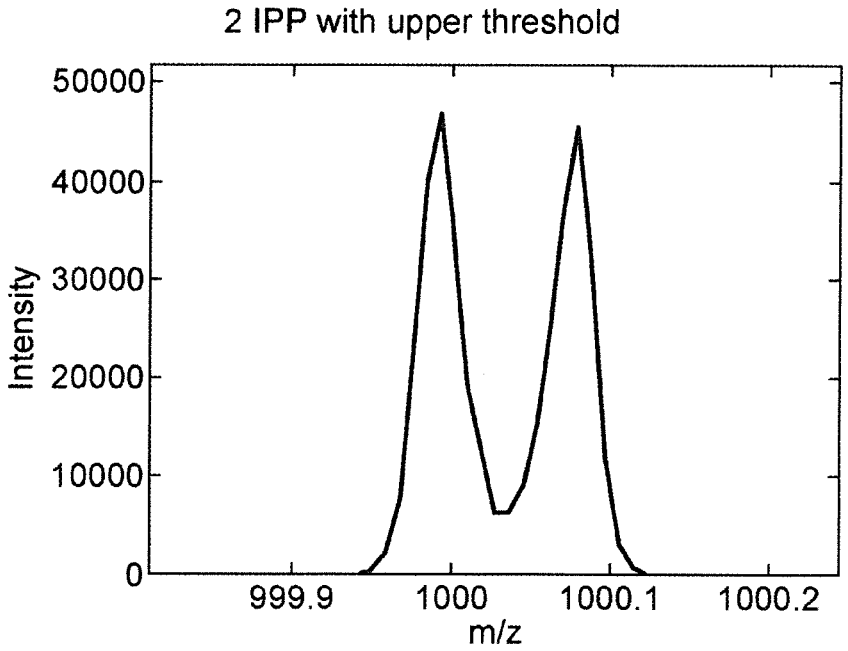

FIG. 5B shows the benefit of the approach according to the embodiment wherein an upper ion peak area threshold is applied so as to result in only ions or ion peaks having an area corresponding to a single ion arrival event are histogrammed.

As can be seen from FIG. 5B, the approach according to the embodiment results in an arrival time distribution ("ATD") which closely resembles the arrival time distribution of a real single ion counting arrival time distribution as shown in FIG. 5A. Advantageously, the practical dynamic range for resolution and mass accuracy is extended according to the embodiment.

The approach according to the embodiment can be extended to produce multiple histogrammed ranges. Values calculated from one histogram such as mass accuracy can be assigned to values calculated in other histograms such as intensity.

In particular, the approach according to the embodiment is particularly advantageous when implemented with ion detector systems wherein a single ion response width provided by the ion detector is comparable with or greater than the arrival time distributions resulting from a Time of Flight analyser. The event area may be correlated with the number of ions in the event. The arrival time distribution of single ion arrival event pushes, double ion arrival event pushes, triple ion arrival event pushes etc. are the same meaning the arrival time distribution of any subset will accurately represent the true arrival time distribution. In practice the pulse height distribution may limit this approach.

Multiple histograms of different areas or combined areas may be kept and the relative values may be used in further analysis.

The mass spectral data may be rescaled based on the number of events or non-events and number of pushes via the Poisson or other appropriate probability distributions.

Other embodiments are contemplated wherein histogramming using heights may be performed and using systems wherein the analogue peak width is less than the arrival time distribution but using the arrival time distribution width to group events together. In the latter alternative, the histogrammed response regions may vary with mass to charge ratio and/or charge state and may be calculated in real time.

Although the technology described herein has been described with reference to the embodiments, it will be understood by those skilled in the art that various changes in form and detail may be made without departing from the scope as set forth in the accompanying claims.

The invention claimed is:

1. A method of mass spectrometry comprising:

digitising a first signal output from an ion detector to produce a first digitised signal;

detecting one or more peaks in said first digitised signal and determining a first area $S_0$ of said one or more peaks and a first arrival time $T_0$ of said one or more peaks thereby forming a first list of data pairs; and determining whether or not said first area $S_0$ exceeds a first threshold area $S_{max}$ , wherein said first threshold area $S_{max}$ corresponds to a peak area indicative of substantially simultaneous arrival of two ions which the ion detector is unable to resolve, and wherein if it is determined that said first area $S_0$ does not exceed said first threshold area $S_{max}$ said method further comprises including said first area $S_0$ or a corresponding first intensity $I_0$ and/or said first arrival time $T_0$ or data derived from said first area $S_0$ or said corresponding first intensity $I_0$ and/or said first arrival time $T_0$ in a first histogram.

2. A method as claimed in claim 1, wherein the step of determining whether or not said first area $S_0$ exceeds said first threshold area $S_{max}$ is made on a push-by-push basis; and/or wherein the step of determining whether or not said first area $S_0$ exceeds said first threshold area $S_{max}$ is made prior to combining or histogramming arrival time and area or intensity data pairs; and/or wherein the step determining whether or not said first area $S_0$ exceeds said first threshold area $S_{max}$ is made prior to combining or histogramming mass spectral data from separate acquisitions in order to build or form a composite mass spectrum.

3. A method as claimed in claim 1, wherein if it is determined that said first area $S_0$ exceeds said first threshold area $S_{max}$ then said method further comprises filtering out, attenuating, rejecting or not including said first area $S_0$ or said corresponding first intensity $I_0$ and/or said first arrival time$T_0$ in said first histogram; and/or wherein the method further comprises filtering out, attenuating or otherwise rejecting one or more data pairs from said first list thereby forming a second reduced list, wherein a data pair is filtered out, attenuated or otherwise rejected from said first list if said first area $S_0$ or said corresponding first intensity $I_0$ of a peak in a data pair in said first list is determined to be less than a second threshold area $S_{min}$ or a threshold intensity $I_{min}$.

4. A method as claimed in claim 1, further comprising converting said first arrival time $T_0$ into a second arrival time $T_n$ and a third arrival time $T_{n+1}$;

optionally further comprising storing said second arrival time $T_n$ and/or said third arrival time $T_{n+1}$ in two or more substantially neighbouring or adjacent pre-determined time bins or memory locations;

and optionally wherein:

(i) said second arrival time $T_n$ is stored in a time bin or memory location immediately prior to or which includes said first arrival time $T_0$; and/or (ii) said third arrival time $T_{n+1}$ is stored in a pre-determined time bin or memory location immediately subsequent to or which includes said first arrival time $T_0$.

5. A method as claimed in claim 1, further comprising converting said first peak area $S_0$ into a second peak area $S_n$ and a third peak area $S_{n+1}$;

optionally further comprising storing said second peak area $S_n$ and/or said third peak area $S_{+1}$ in two or more substantially neighbouring or adjacent pre-determined time bins or memory locations;

optionally wherein:

(i) said second peak area $S_n$ is stored in a pre-determined time bin or memory location immediately prior to or which includes said first arrival time $T_0$; and/or (ii) said third peak area $S_{n+1}$ is stored in a pre-determined time bin or memory location immediately subsequent to or which includes said first arrival time $T_0$;

optionally wherein:

(i) said first peak area $S_0$ follows the relationship $S_0=S_n+S_{n+1}$; and/or (ii) $S_0 \cdot T_0$ follows the relationship $S_n \cdot T_n+S_{n+1} \cdot T_{n+1}=S_0 \cdot T_0$.

6. A method as claimed in claim 5, further comprising replacing said first arrival time $T_0$ and said first peak area $S_0$ of at least some of the peaks with said second arrival time $T_n$ and said second peak area $S_n$ and said third arrival time $T_{n+1}$ and said third peak area $S_{n+1}$.

7. A method as claimed in claim 1, further comprising converting said first intensity $I_0$ into a second intensity $I_n$ and a third intensity $I_{n+1}$;

optionally further comprising storing said second intensity $I_n$ and/or said third intensity $I_{n+1}$ in two or more substantially neighbouring or adjacent pre-determined time bins or memory locations.

8. A method as claimed in claim 4, wherein each predetermined time bin or memory location has a width, wherein the width falls within a range selected from the group consisting of: (i)<1 ps; (ii) 1-10 ps; (iii) 10-100 ps; (iv) 100-200 ps; (v) 200-300 ps; (vi) 300-400 ps; (vii) 400-500 ps; (viii) 500-600 ps; (ix) 600-700 ps; (x) 700-800 ps; (xi) 800-900 ps; (xii) 900-1000 ps; (xiii) 1-2 ns; (xiv) 2-3 ns; (xv) 3-4 ns; (xvi) 4-5 ns; (xvii) 5-6 ns; (xviii) 6-7 ns; (xix) 7-8 ns; (xx) 8-9 ns; (xxi) 9-10 ns; (xxii) 10-100 ns; (xxiii) 100-500 ns; (xxiv) 500-1000 ns; (xxv) 1-10 μs; (xxvi) 10-100 μs; (xxvii) 100-500 μs; (xxviii)>500 μs; and/or wherein the method further comprises:

obtaining said first signal over an acquisition time period, wherein the length of said acquisition time period is selected from the group consisting of: (i)<1 μs; (ii) 1-10 μs; (iii) 10-20 μs; (iv) 20-30 μs; (v) 30-40 μs; (vi) 40-50 μs; (vii) 50-60 μs; (viii) 60-70 μs; (ix) 70-80 μs; (x) 80-90 μs; (xi) 90-100 μs; (xii) 100-110 μs; (xiii) 110-120 μs; (xiv) 120-130 μs; (xv) 130-140 μs; (xvi) 140-150 μs; (xvii) 150-160 μs; (xviii) 160-170 μs; (xix) 170-180 μs; (xx) 180-190 μs; (xxi) 190-200 μs; (xxii) 200-250 μs; (xxiii) 250-300 μs; (xxiv) 300-350 μs; (xxv) 350-400 μs; (xxvi) 450-500 μs; (xxvii) 500-1000 μs; and (xxviii) >1 ms;

wherein said method further comprises sub-dividing said acquisition time period into n time bins or memory locations, wherein n is selected from the group consisting of: (i)<100; (ii) 100-1000; (iii) 1000-10000; (iv) 10,000-100,000; (v) 100,000-200,000; (vi) 200,000-300,000; (vii) 300,000-400,000; (viii) 400,000-500,000; (ix) 500,000-600,000; (x) 600,000-700,000; (xi) 700,000-800,000; (xii) 800,000-900,000; (xiii) 900,000-1,000,000; and (xiv)>1,000,000;

wherein each said time bin or memory location has substantially the same length, width or duration.

9. A method as claimed claim 1, wherein:

(i) said first signal comprises an output signal, a voltage signal, an ion signal, an ion current, a voltage pulse or an electron current pulse; and/or (ii) said ion detector comprises a microchannel plate, a photomultiplier or an electron multiplier device; and/or (iii) said ion detector comprises a current to voltage converter or amplifier for producing a voltage pulse in response to the arrival of one or more ions at said ion detector.

10. A method as claimed in claim 1, further comprising at least one of:

subtracting a constant number or value from said first digitised signal, wherein if a portion of said first digitised signal falls below zero after subtraction of a constant number or value from said first digitised signal then said method further comprises resetting said portion of said first digitised signal to zero;

applying an amplitude threshold to said first digitised signal prior to determining said first area $S_0$ or said first intensity $I_0$ of said one or more peaks and said first arrival time $T_0$ of said one or more peaks in order to filter out at least some noise spikes from said first digitised signal;

smoothing said first digitised signal using a moving average, boxcar integrator, Savitsky Golay or Hites Biemann algorithm prior to determining said first area $S_0$ or said first intensity $I_0$ of said one or more peaks and said first arrival time $T_0$ of said one or more peaks; and determining or obtaining a second differential or a second difference of said first digitised signal prior to determining said first area $S_0$ or said first intensity $I_0$ of said one or more peaks and said first arrival time $T_0$ of said one or more peaks, optionally wherein said step of determining said first arrival time $T_0$ of said one or more peaks comprises determining one or more zero crossing points of said second differential of said first digitised signal, optionally wherein the method further comprises:

determining or setting a start time $T_{0start}$ of an ion arrival event as corresponding to a digitisation interval which is immediately prior or subsequent to the time when said second differential of said first digitised signal falls below zero or another value; and determining or setting an end time $T_{0end}$ of an ion arrival event as corresponding to a digitisation interval which is immediately prior or subsequent to the time when said second differential of said first digitised signal rises above zero or another value.

11. A method as claimed in claim 10, further comprising:

(i) determining the peak area of one or more peaks present in said first digitised signal which correspond to one or more ion arrival events, wherein the step of determining the peak area of one or more peaks present in said first digitised signal comprises determining the area of one or more peaks present in said first digitised signal bounded by said start time $T_{0start}$, and/or by said end time $T_{0end}$; and/or (ii) determining the moment of one or more peaks present in said first digitised signal which correspond to one or more ion arrival events, wherein the step of determining the moment of one or more peaks present in said first digitised signal which correspond to one or more ion arrival events comprises determining the moment of a peak bounded by said start time $T_{0start}$ and/or by said end time $T_{0end}$; and/or (iii) determining the centroid time of one or more peaks present in said first digitised signal which correspond to one or more ion arrival events; and/or (iv) determining the average or representative time of one or more peaks present in said first digitised signal which correspond to one or more ion arrival events.

12. A method as claimed in claim 1, further comprising using an Analogue to Digital Converter or a transient recorder to digitise said first signal; optionally wherein:

(a) said Analogue to Digital Converter or transient recorder comprises a n-bit Analogue to Digital Converter or transient recorder, wherein n comprises 5, 6, 7, 8, 9, 10, 11, 12, 13, 14, 15, 16, 17, 18, 19, 20 or>20; and/or (b) said Analogue to Digital Converter or transient recorder has a sampling or acquisition rate selected from the group consisting of: (i)<1 GHz; (ii) 1-2 GHz; (iii) 2-3 GHz; (iv) 3-4 GHz; (v) 4-5 GHz; (vi) 5-6 GHz;

(vii) 6-7 GHz; (viii) 7-8 GHz; (ix) 8-9 GHz; (x) 9-10 GHz; and (xi)>10 GHz; and/or (c) said Analogue to Digital Converter or transient recorder has a digitisation rate which is substantially uniform or non-uniform.

13. A method as claimed in claim 1, further comprising:

digitising one or more further signals output from said ion detector to produce one or more further digitised signals;

detecting one or more peaks in said one or more further digitised signals and determining a first area $S_0$ of said one or more peaks and a first arrival time $T_0$ of said one or more peaks thereby forming a first list of data pairs; and determining whether or not said first area $S_0$ exceeds a first threshold area $S_{max}$, wherein if it is determined that said first area $S_0$ does not exceed said first threshold area $S_{max}$ then said method further comprises including said first area $S_0$ or a corresponding first intensity $I_0$ and/or said first arrival time $T_0$ or data derived from said first area $S_0$ or said corresponding first intensity $I_0$ and/or said first arrival time $T_0$ in said first histogram;

optionally wherein said one or more further signals comprise at least 5, 10, 15, 20, 25, 30, 35, 40, 45, 50, 55, 60, 65, 70, 75, 80, 85, 90, 95, 100, 200, 300, 400, 500, 600, 700, 800, 900, 1000, 2000, 3000, 4000, 5000, 6000, 7000, 8000, 9000 or 10000 signals from said ion detector, each signal corresponding to a separate experimental run or acquisition;

optionally wherein the method further comprises combining or histogramming a second peak area $S_n$ and a third peak area $S_{n+1}$ corresponding to said first digitised signal with second peak area(s) $S_n$ and third peak area(s) $S_{n+1}$ corresponding to said one or more further digitised signals to form a composite time or mass spectrum.

14. A method as claimed in claim 1, further comprising:

determining whether or not said first area $S_0$ or said first intensity $I_0$ exceeds a third threshold area $S'_{max}$ or a third threshold intensity $I'_{max}$, wherein if it is determined that said first area $S_0$ or said first intensity $I_0$ does not exceed said third threshold area $S'_{max}$ or said third threshold intensity $I_0$ then said method further comprises including said first area $S_0$ or said first intensity $I_0$ and/or said first arrival time $T_0$ or data derived from said first area $S_0$ or said first intensity $I_0$ and/or said first arrival time $T_0$ in said first histogram;

optionally further comprising filtering out, attenuating or otherwise rejecting one or more data pairs, wherein a data pair is filtered out, attenuated or otherwise rejected if said first area $S_0$ or said first intensity $I_0$ is determined to be less than a fourth threshold area $S'_{min}$ or a fourth threshold intensity $I'_{min}$;

optionally further comprising determining one or more further characteristics or metrics related to said one or more peaks, optionally wherein said one or more further characteristics or metrics related to said one or more peaks comprise: (i) the standard deviation of said one or more peaks, the full width at half maximum ("FWHM") of said one or more peaks or another value relating to the width or peak shape of said one or more peaks; and/or (ii) the kurtosis of said one or more peaks; and/or (iii) the skew of said one or more peaks, the absolute value of the skew of said one or more peaks or the modulus of the skew of said one or more peaks.

15. A method as claimed in claim 14, wherein said method further comprises at least one of:

determining whether or not said one or more further characteristics or metrics exceeds a first maximum threshold $X_{max}$, wherein:

(i) if it is determined that said one or more further characteristics or metrics does not exceed said first maximum threshold $X_{max}$ then said method further comprises including said first area $S_0$ or said first intensity $I_0$ and/or said first arrival time $T_0$ or data derived from said first area $S_0$ or said first intensity $I_0$ and/or said first arrival time $T_0$ in said first histogram; and/or (ii) if it is determined that said one or more further characteristics or metrics exceeds said first maximum threshold $X_{max}$ then said method further comprises filtering out, attenuating, rejecting or not including said first area $S_0$ or said first intensity $I_0$ and/or said first arrival time$T_0$ in said first histogram; and determining whether or not said one or more further characteristics or metrics exceeds a first minimum threshold $X_{min}$, wherein:

(i) if it is determined that said one or more further characteristics or metrics exceeds said first minimum threshold $X_{min}$ then said method further comprises including said first area $S_0$ or said first intensity $I_0$ and/or said first arrival time $T_0$ or data derived from said first area $S_0$ or said first intensity $I_0$ and/or said first arrival time $T_0$ in said first histogram; and/or (ii) if it is determined that said one or more further characteristics or metrics does not exceed said first minimum threshold $X_{min}$ then said method further comprises filtering out, attenuating, rejecting or not including said first area $S_0$ or said first intensity $I_0$ and/or said first arrival time$T_0$ in said first histogram.

16. A control system for a mass spectrometer, wherein said control system is arranged and adapted to perform the method of claim 1;

wherein said control system is arranged and adapted:

(i) to digitise a first signal output from an ion detector to produce a first digitised signal;

(ii) to detect one or more peaks in said first digitised signal and to determine a first area $S_0$ of said one or more peaks and a first arrival time $T_0$ of said one or more peaks thereby forming a first list of data pairs; and (iii) to determine whether or not said first area $S_0$ exceeds a first threshold area $S_{max}$, wherein said first threshold area $S_{max}$ corresponds to a peak area indicative of substantially simultaneous arrival of two ions which the ion detector is unable to resolve, and wherein if it is determined that said first area $S_0$ does not exceed said first threshold area $S_{max}$ then said control system is further arranged and adapted to include said first area $S_0$ or a corresponding first intensity $I_0$ and/or said first arrival time $T_0$ or data derived from said first area $S_0$ or said corresponding first intensity $I_0$ and/or said first arrival time $T_0$ in a first histogram.

17. A mass spectrometer comprising a control system as claimed in claim 16, said mass spectrometer optionally further comprising an Analogue to Digital Converter or a transient recorder to digitise said first signal, optionally wherein:

(a) said Analogue to Digital Converter or transient recorder comprises a n-bit Analogue to Digital Converter or transient recorder, wherein n comprises 5, 6, 7, 8, 9, 10, 11, 12, 13, 14, 15, 16, 17, 18, 19, 20 or>20; and/or (b) said Analogue to Digital Converter or transient recorder has a sampling or acquisition rate selected from the group consisting of: (i)<1 GHz; (ii) 1-2 GHz; (iii) 2-3 GHz; (iv) 3-4 GHz; (v) 4-5 GHz; (vi) 5-6 GHz; (vii) 6-7 GHz; (viii) 7-8 GHz; (ix) 8-9 GHz; (x) 9-10 GHz; and (xi)>10 GHz; and/or (c) said Analogue to Digital Converter or transient recorder has a digitisation rate which is substantially uniform or non-uniform.

* * * * *